United States Patent [19]

Brundiek

[11] 4,084,754

[45] Apr. 18, 1978

[54] COMBINED VANE-ROTOR SEPARATOR

[75] Inventor: Horst Brundiek, Neuss, Germany

[73] Assignee: Loesche Hartzerkleinerungs-und Zementmaschinen GmbH & Co. KG, Germany

[21] Appl. No.: 708,935

[22] Filed: Jul. 27, 1976

[51] Int. Cl.[2] ..... B02C 23/12

[52] U.S. Cl. ..... 241/52; 241/58; 241/119; 241/79

[58] Field of Search ..... 241/52, 53, 58, 79, 241/79.1, 117, 118, 119

[56] References Cited

U.S. PATENT DOCUMENTS

| | | | |
|---|---|---|---|
| 1,721,594 | 7/1929 | Hardinge | 241/52 |
| 2,275,595 | 3/1942 | Schwartz | 241/58 |
| 2,909,330 | 10/1959 | Hardinge | 241/58 |
| 3,044,714 | 7/1962 | Ballantine | 241/58 |
| 3,285,523 | 11/1966 | Duyckinck et al. | 241/53 |

*Primary Examiner*—Granville Y. Custer, Jr.
*Attorney, Agent, or Firm*—Holman & Stern

[57] ABSTRACT

A combined vane-rotor separator comprises a rotor, which has upstanding impellor baffle rails arranged at the outer periphery thereof. A housing surrounds the rotor to which a feed mixture is supplied in a gas flow from a roll mill and from which the gas and fines leave through a draw-off duct. A cone is located below the rotor and is attached to the housing. A series of guide vanes arranged in a ring is located between the housing and the cone and serves as a guide for the gas flow from the roll mill.

3 Claims, 8 Drawing Figures

COMBINED VANE-ROTOR SEPARATOR

BACKGROUND OF THE INVENTION

1. Field to which the invention relates

The present invention relates to the construction of a separator for feed mixtures with a rotor, more particularly as a top fitting for roll mills, which at its external periphery has upstanding impeller baffle rails, with a housing surrounding the rotor and to which a feed mixture is supplied in a gas flow and from which the gas containing fines emerges in an upward direction through a draw-off duct.

2. The prior art

With increasing requirements as regards the throughput of roll mills their dimensions have also become larger and larger. Tests and investigations have shown that in the case of known separators the energy or power requirement is disproportionally large owing to the necessary deflection of the gas flow. One aim of the present invention is accordingly that of continuing the spin or rotary movement of the gas flow, which is produced by a blade ring surrounding the grinding pan and so amplifying it that the dust gas mixture can be accelerated with the lowest possible power requirement in an improved manner up to the peripheral speed of the rotor. In the case of one construction for attaining this aim the power requirement can be substantially decreased, something which is particularly significant in the case of roll mills with large dimensions.

SUMMARY OF INVENTION

Accordingly the present invention resides in that between the separator housing and a cone there is a series of guide vanes arranged in a ring serving as a spin producer or, respectively, a spin amplifier. In the case of one embodiment of the invention the vanes can be adjusted and locked in position by means of a handle acting via a pivoting rod, which is journalled in the separator housing and the cone and extends outwards from the housing wall.

In another embodiment of the invention the vanes are welded in a fixed manner between the separator housing and the cone in accordance with the direction of the blades of the blade ring surrounding the grinding pan.

LIST OF VIEWS OF DRAWINGS

In the drawings the invention is shown in conjunction with a roll mill.

Figure 5:
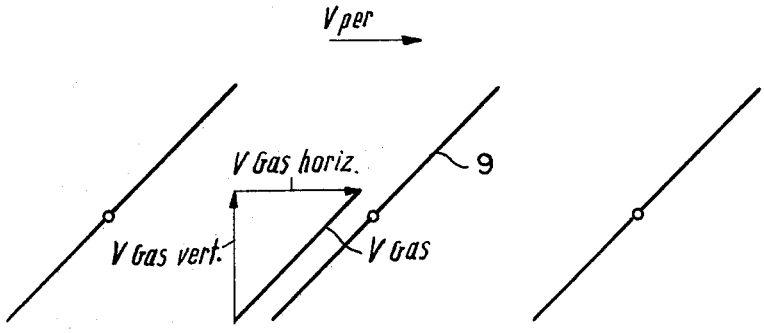

FIG. 5 diagrammatically shows the gas speed vectors between two guide vanes.

Figure 6:
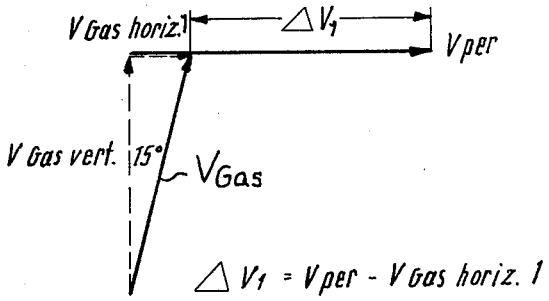
Figure 7:
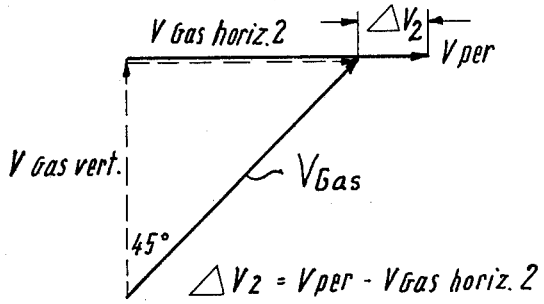
Figure 8:
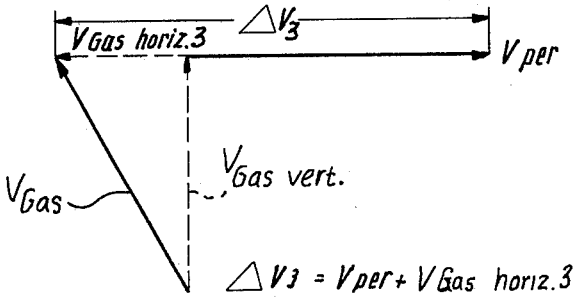

FIGS. 6 to 8 show graphically for various guide vane angles and directions the gas speed vectors in comparison with the vector constant in a horizontal direction, of the rotor peripheral speed.

DESCRIPTION OF PREFERRED EMBODIMENTS

Figure 1:
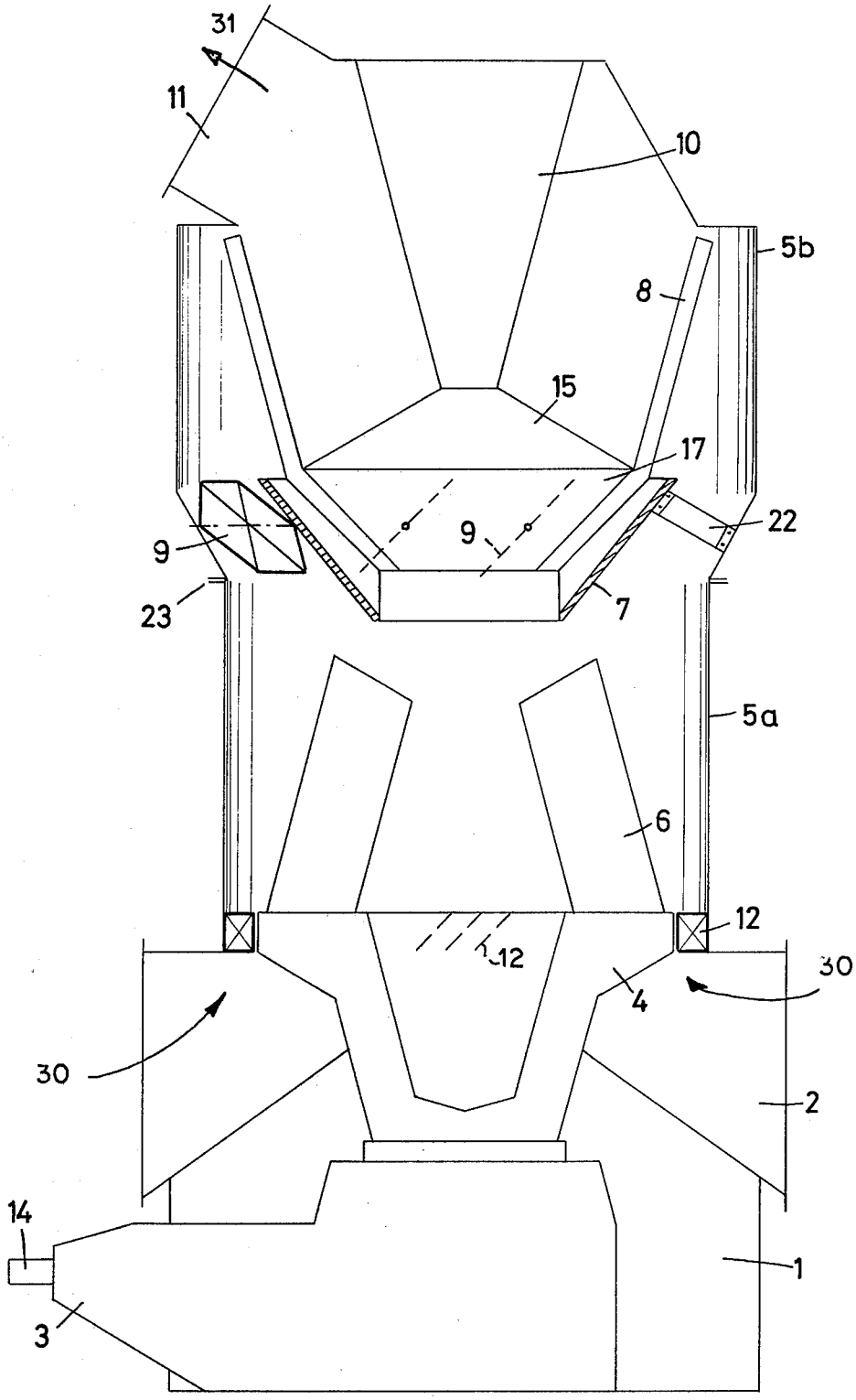
FIG. 1 shows diagrammatically a roll mill with a separator mounted on top of it and constructed in accordance with the invention.
Figure 2:
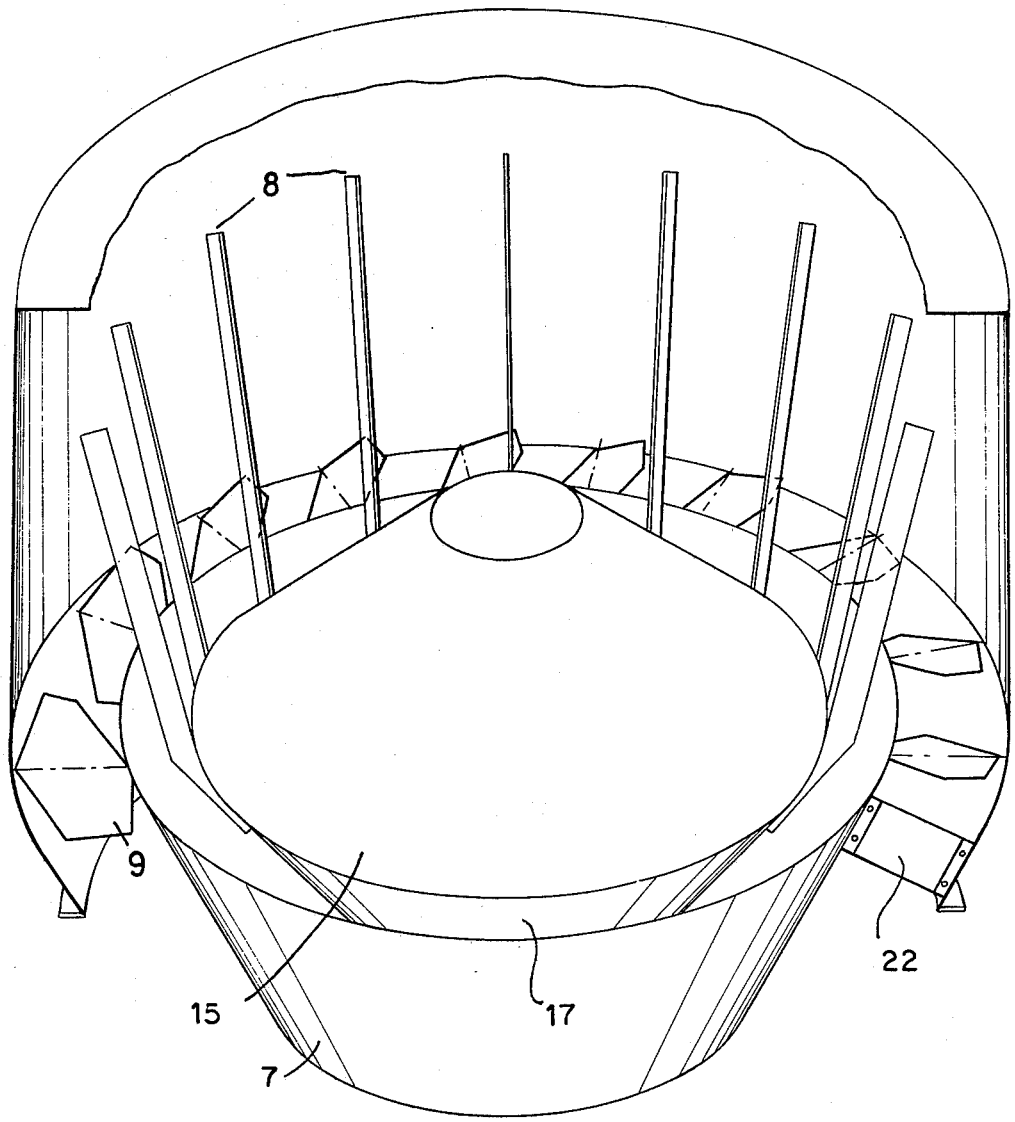
FIG. 2 shows a three-dimensional view of the guide vanes arranged in a ring in accordance with the invention.

FIG. 1 shows a roll mill with a separator device mounted in position on top of it embodying the invention. A lower part 1, which carries the roll mill, is provided with outlets 2 for tails which cannot be processed. In the interior of the lower part there is a gearing 3, which transmits the force provided at a drive shaft 14 to a grinding pan 4. The grinding work between the grinding pan 4 and rolls 6 is produced owing to the fact that only the grinding pan 4 turns while the rolls 6 are arranged in a stationary, swinging manner. A blade ring having individual blades 12 surrounds the grinding pan. These parts are surrounded by a housing wall *5a* of the roll mill, and a separator housing is denoted by reference *5b*. A cone 7 is attached in a stationary manner in the housing *5b* of the separator and serves for guiding the gas flow, (denoted by arrows 30) directed upwards in the mill and in the separator, and for proper return of the tails rejected by the separator between a baffle rail rotor and its inner side to the center of the mill onto the grinding pan 4. In FIG. 1 a fixed holding means 22 is used to attach the cone 7 to the separator housing *5b*. Reference 23 denotes a flange connection between *5a* and *5b*.

Above the cone 7 there are rotating impellor baffle rails 8. The baffle rail rotor which comprises conical parts 15 and 17 and the baffle rails 8 is mounted for rotation relative to a cone 10 in a conventional manner. Between the housing wall *5b* and the cone 7 there is a series of guide vanes 9 arranged in a ring. The vanes 9 are made oblique or rounded off adjacent to the housing and the cone in order to ensure that on swinging into another angular position or, respectively, on changing their direction they can match the curvature of the housing *5b* and of the cone 7. The vanes 9 welded in a fixed manner in position in the construction have their outer and inner edges making contact with the housing wall *5b* and the outer wall of the cone 7 for the full length in order to make welding possible. The effect obtained by the guide vanes will be explained below with reference to FIGS. 5 to 8. The gas containing fines emerges through a draw-off duct 11 in the direction of a mill blower (denoted by arrow 31).

Figure 3:
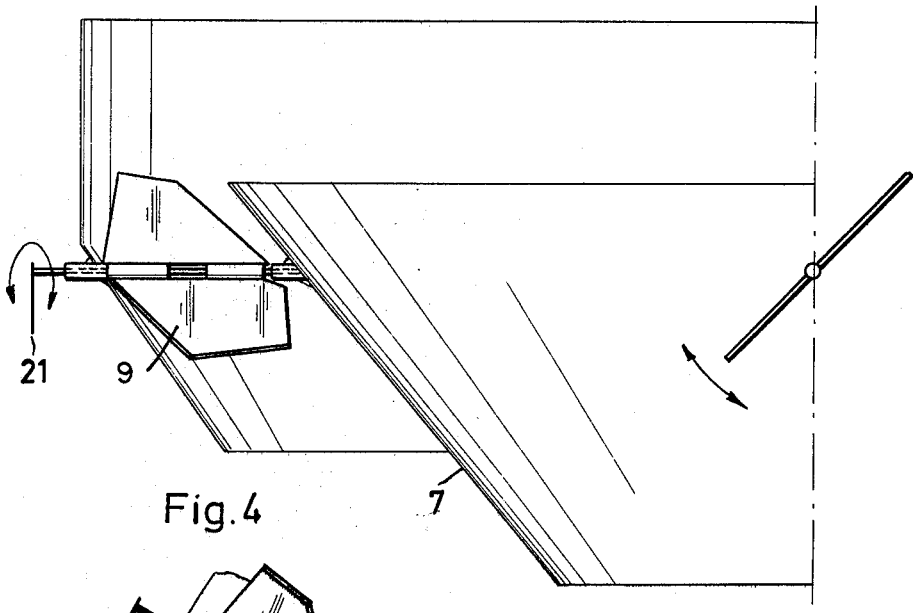
FIG. 3 shows a part-view of a guide vane and its arrangement.
Figure 4:
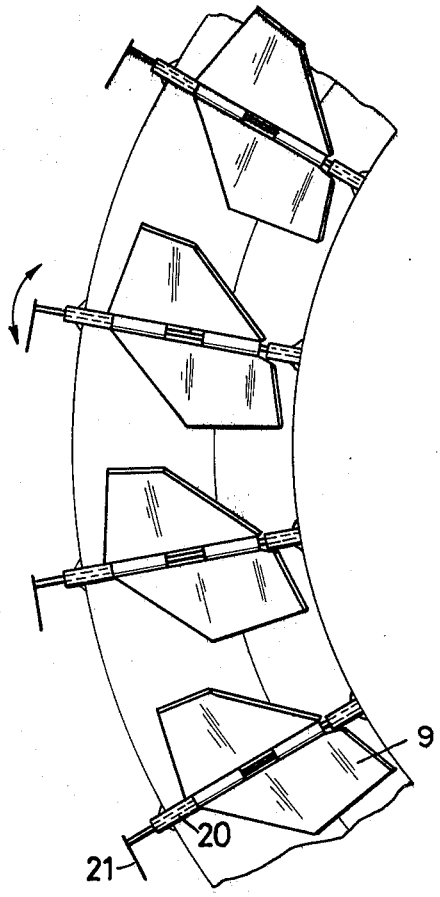
FIG. 4 shows a three-dimensional view of several guide vanes, which are constructed in accordance with the representation in FIG. 3.

The representation in FIGS. 3 and 4 shows the arrangement of the vanes 9 on a shaft 20, which is journalled at both ends, extends outwards through the housing wall *5b* and at this position is provided with a handle 21 and a locking device (for example a lock-nut) for purposes of adjustment.

Explanation of symbols in FIG. 5

$v_{per}$ = peripheral speed of rotor $v_{gas}$ = gas speed or velocity of the dust gas mixture between two vanes $v_{gas\ vert.}$ = vertical speed component of the dust gas mixture at the guide vane exit $v_{gas\ horiz.}$ = horizontal speed component of the dust gas mixture at the guide vane outlet Delta $v = v_{per} - v_{gas\ horiz.}$ = difference in velocity of the rotor peripheral speed component of the dust gas mixture FIG. 5 shows in this respect the speed vector produced in the case of a certain oblique setting of the guide vanes and a certain direction of rotation of the rotor, that is to say a defined peripheral speed of the rotor.

Accordingly the aim in the case of the guide vanes in accordance with the invention resides in continuing or prolonging the spin of the gas flow, which is due to the blade ring surrounding the grinding pan and to amplify it so that the dust gas mixture, which is supplied to the separator rotor, can be more readily accelerated by the latter up to the rotor peripheral speed; that is to say the separator rotor is to deflect the dust gas mixture drawn in by the mill blower and conveyed upwards in the mill to such an extent and up to its peripheral speed that it is only possible for the fines, together with the carrying gas, to be deflected into the space within the rotor baffle rails. Coarse grains are engaged by the baffle rails and thrown off outwards by centrifugal force. The acceleration force to be performed at the rotor in respect of the dust gas mixture increases with an increase in the angle between the upwardly directed flow vector of the dust gas mixture and the horizontally running vector of the rotor peripheral speed. Let it be assumed that the dust gas mixture flows vertically upward and it is then necessary to deflect the flow through 90° into the tangential movement of the rotor; in other words the dust gas mixture is to be accelerated from the horizontal speed of zero to the horizontal speed, which corresponds to the peripheral speed at the rotor baffle rails. If the dust gas mixture is provided with a prespin by means of the guide vanes in the manner indicated in the direction of rotor rotation, the dust gas mixture will already have a horizontal component of speed dependent on its inclination. The necessary acceleration is then only the difference between the rotor peripheral speed and the horizontal component of the dust gas flow. It is readily to be understood, furthermore the matter has been proved by tests, that the deflection and acceleration energy at the rotor substantially increases if the dust gas flow is subject to spin in the guide vanes, this spin opposite to the direction of rotation of the rotor. In this case the peripheral speed of the rotor and the horizontal component of the dust gas mixture are added.

By dint of the guide vanes it is therefore possible to reduce substantially the rotary energy to be produced at the separator rotor. The development of the size of the separators, which are arranged as air flow separators directly on a roll mill and form a process unit with it, has in recent times progressed so far that drive powers of approximately 200 kW are required taking into account guide vanes.

In FIG. 7 it will be seen that in the case of a guide vane setting of 45° the vertical component of the gas flow is equal to the horizontal component. The difference between the rotor peripheral speed and the horizontal component of the gas flow, that is to say $$\text{Delta}v = v_{per} - v_{gas\ horiz.}$$

is the amount by which the gas column must be accelerated in order to reach the peripheral speed of the rtor.

Referring to FIG. 6 of the drawings it will be seen that the difference between the peripheral rotor speed and the horizontal speed of the gas dust micture is significant when there are no guide vanes in the roll mill described hereinbefore. In such a mill the gas flow leaves the blade ring 12 at an angle of approximately 35° relative to a horizontal plane and moves upwardly in a helical path. Due to the suction of the mill blower the gradient of the helical flow path becomes steeper as the gas dust mixture approaches the baffle rails so that the flow of the gas dust mixture encounters the baffle rails at an angle of approximately 15° relative to a vertical plane. The angle of 15° defined between the direction of travel of the gas dust mixture and the vertical plane is the same angle as the one defined between the vertical speed component of the flow of the gas dust mixture and the gas speed vector in the velocity triangle shown in FIG. 6. Comparing Delta $v_1$ in FIG. 6 with Delta $v_2$ in FIG. 7, it will be apparent that less power is required to accelerate the gas flow carrying the dust particles up to the peripheral rotor speed when the guide vanes are present and set at an angle of 45° than when there are no guide vanes. While the horizontal component in the case of a flow angle of 45° can be taken as tan 45° = 1 = 100%, the horizontal component decreases in the case of a flow angle of 15° with respect to the vertical to tan 15° = 0.27 = 27%. Without guide vanes the acceleration work to be performed and therefore the rotor drive power to be provided for in the construction is accordingly substantially larger than with guide vanes. For the machine in accordance with the invention making use of guide vanes there is a substantial saving in power in the course of time and the costs for a smaller driving unit are also smaller.

FIG. 8 shows qualitatively to what extent the acceleration work would have to be further increased if the spin of the gas flow, when it leaves the blade ring at the grinding pan were to be guided in a direction opposite to the direction of the rotor in ignorance of the physical basis, or, to take the converse case, if the rotor had to be driven in a direction opposite to the gas spin in the mill and separator housing. In this case we have $$\text{Delta} = v_{per} + v_{gas\ horiz.}$$

In addition to the mechanical advantage of a saving in power the invention also involves the process advantage that the particle distribution curve of the product of grinding is improved, that is to say with a reduced power requirement the same or even an improved fineness of the product can be obtained as compared with a prior art separator without guide vanes and whose rotor would have to run faster.

I claim:

1. In a comminuting apparatus comprising: a roll mill including a grinding pan and a blade ring having blades surrounding the grinding pan; and a combined vane rotor separator mounted on top of the roll mill, the separator including a rotor which has upstanding impellor baffle blades arranged at the periphery thereof, a housing surrounding the rotor to which a feed mixture is supplied in a gas flow from the roll mill and from which the gas and fines leave through a draw-off duct, and a cone located below the rotor and attached to the housing; the improvement wherein the separator further comprises a series of guide vanes arranged in a ring, the series of guide vanes located between the housing of the separator and the cone and adapted to operate as a flow guide device.

2. The apparatus as set forth in claim 1 characterized in that each of the vanes has a handle on a pivot rod and the handle projects from the housing wall.

3. The apparatus as set forth in claim 1 characterized in that the vanes are welded in position in a fixed manner between the separator housing and the cone in accordance with the direction of the blades of the blade ring surrounding the grinding pan.

* * * * *